United States Patent [19]

Campbell

[11] 4,076,361

[45] Feb. 28, 1978

[54] ELECTRICAL CONNECTOR ASSEMBLY FOR USE WITH REMOTE MANIPULATOR

[75] Inventor: Robert F. Campbell, Irvine, Calif.

[73] Assignee: Gulton Industries, Inc., Metuchen, N.J.

[21] Appl. No.: 641,552

[22] Filed: Dec. 17, 1975

[51] Int. Cl.[2] ..... H01R 13/54

[52] U.S. Cl. ..... 339/75 M; 339/91 R; 339/113 R

[58] Field of Search ..... 339/75 R, 75 M, 91 R, 339/91 P, 113 R, 113 L, 65, 66 M, 170 M, 255 R

[56] References Cited

U.S. PATENT DOCUMENTS

| | | | |
|---|---|---|---|
| 2,677,811 | 5/1954 | Anderson et al. | 339/91 R |
| 2,724,093 | 11/1955 | Preston | 339/75 M |
| 2,809,361 | 10/1957 | Woofter et al. | 339/176 M |
| 3,094,364 | 6/1963 | Lingg | 339/65 X |
| 3,546,658 | 12/1970 | Van Horssen et al. | 339/91 R X |
| 3,810,073 | 5/1974 | Zajac et al. | 339/91 R |

FOREIGN PATENT DOCUMENTS

| | | | |
|---|---|---|---|
| 246,538 | 10/1947 | Switzerland | 339/91 R |

*Primary Examiner*—Roy Lake
*Assistant Examiner*—E. F. Desmond
*Attorney, Agent, or Firm*—Wallenstein, Spangenberg, Hattis & Strampel

[57] ABSTRACT

The remote, manipulator, attachable, connector apparatus includes telescoping outer and inner connector units, one of which preferably the outer one, has on the end thereof remote from the other connector unit an elbow portion laterally extending therefrom which preferably can be swiveled and locked and in any position in a plane transverse to the longitudinal axis of the assembly. The latter connector unit has exposed preferably on opposite diametrically sides thereof a pair of outwardly, spring-urged, depressible members having operating, brightly colored latch members adapted to interlock with the other connector unit when the depressible members are in their outermost positions. If the depressible members are released, as the connector units are moved fully into telescoping relation, the latch members slide along raised surfaces of the other connector unit where they are readily visible. When the connector units are fully telescoped, the latch members disappear into locking recesses which prevent separation of the connector units until the depressible members are externally depressed. The provision of an elbow on the connector unit having the depressible members permits access to the depressible members by the grasping jaws of a remotely controlled manipulator brought into position behind the elbow where they can freely rotate as a unit about a longitudinal axis to align the connector units. Unique guide means are provided for automatically guiding the connector units axially and circumferentially into proper alignment if one connector unit is moved longitudinally with respect to the other connector unit.

17 Claims, 10 Drawing Figures

2
8
12
16
18
21
21a
21b
22
22a
23
24
25
25'
26
28
28'
29a
30
30a
31
31a
32'
33'
34'
35'
36
36'
37
37'
38
41
43
46
46'
48
48'
50
50'
54
55
56
58
59
60
61
62
63
64
64a
66
68
70
72
73
74
76
76'
77
79
81
82
84
86
87
92
94
97
98
98a
100
105
107
107b
108
108'
109
110
111
4
6
7

Fig. 3A.
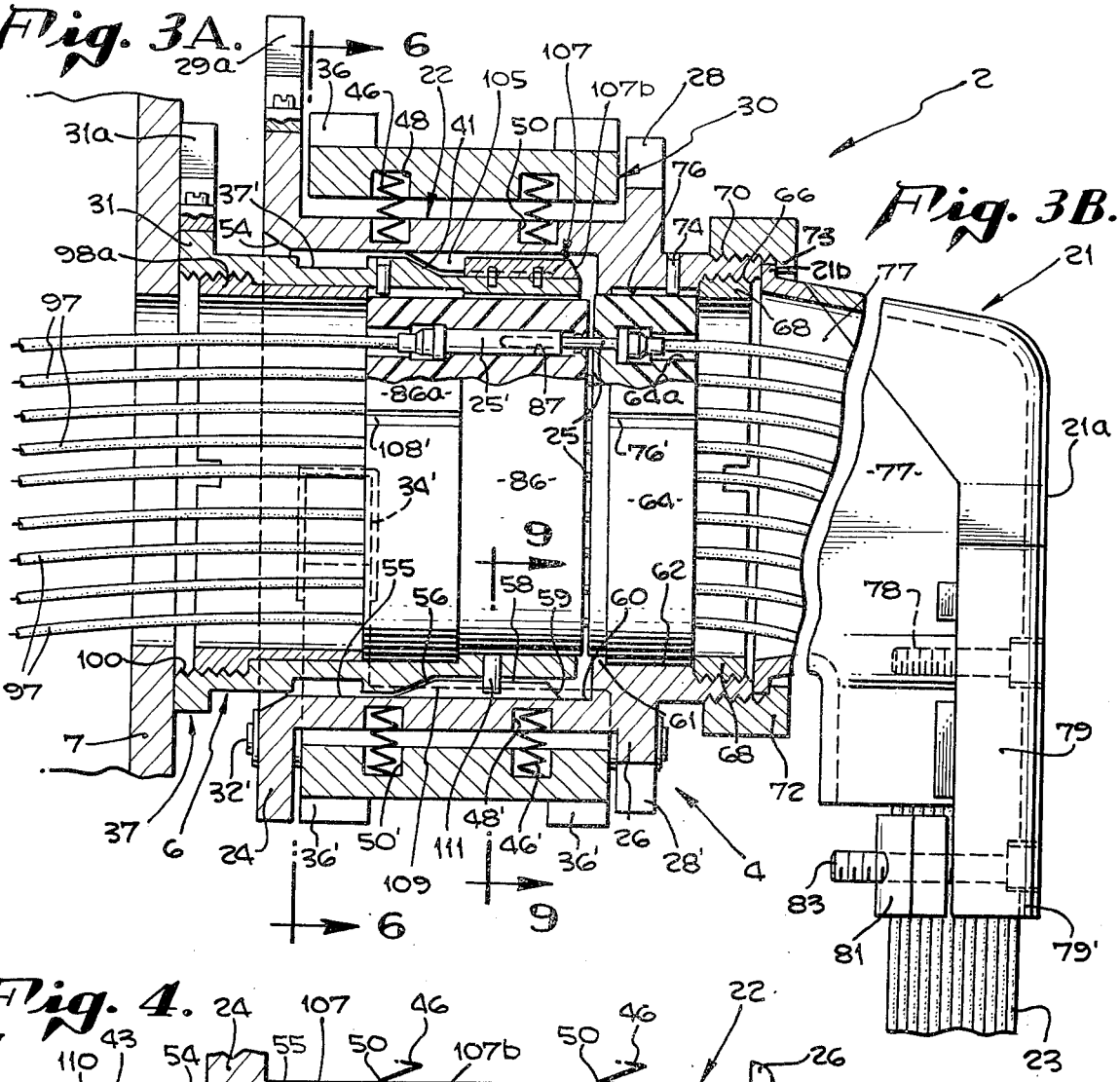
Fig. 3B.
Fig. 4.
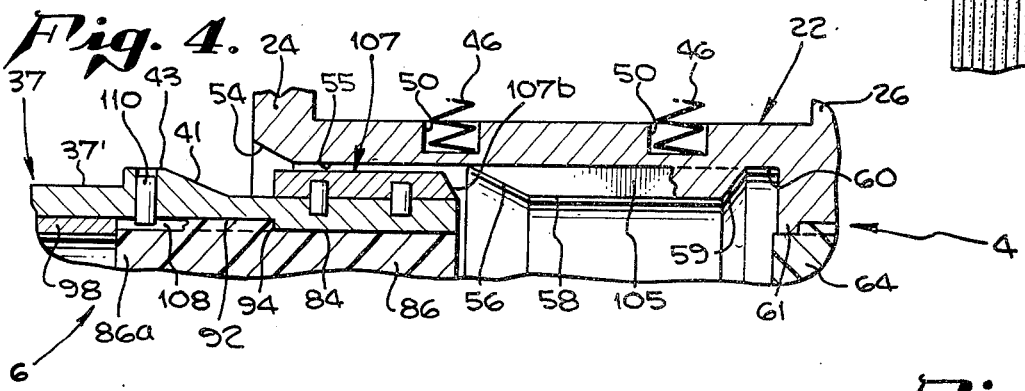
Fig. 5.
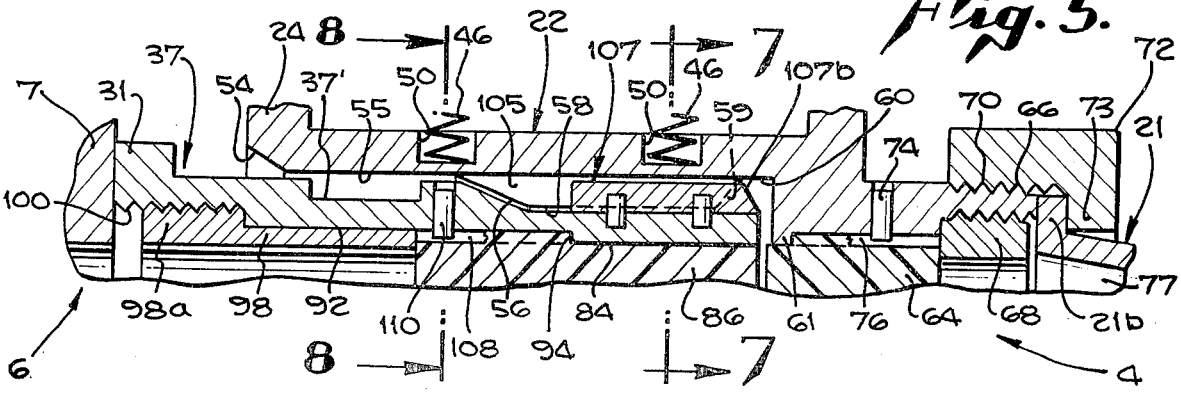

ELECTRICAL CONNECTOR ASSEMBLY FOR USE WITH REMOTE MANIPULATOR

BACKGROUND OF THE INVENTION

This invention relates to electrical connectors specifically designed for assembly and dis-assembly by remotely controlled manipulators adapted to grasp one of the connector units and bring the same into proper axial and circumferential alignment and full interconnection with another connector unit generally mounted on a stationary wall. A common form of such a manipulator comprises a pair of confronting grasping jaws carried on the end of a lever system duplicating most of the main parts and motions of a human arm. Such manipulators are required, for example, in handling various articles, including electrical connectors in nuclear power plants and the like, where dangerous radiation conditions require the use of remotely controlled manipulators.

Due to the control and inertial problems of such remotely controlled manipulators, it was heretofore not uncommon for the operator to have great difficulty in using such manipulators to bring the connector units into telescoping relation with a sufficiently close axial and circumferential angular alignment to avoid damaging the connectors. Thus, even a small misalignment in the axial or circumferential angular alignment of the connector units as they are forced together by a manipulator caused substantial damage to the connector units. While the operator usually had television or telescopic visual aids in directing the manipulator arm carrying the movable connector unit, such aids were frequently inadequate to attain the desired degree of alignment to avoid damage, for example, to misaligned plug terminals pushed against the edges or other abutments adjacent to the associated socket terminals of a female connector unit.

It is, accordingly, an object of the present invention to provide a connector assembly specifically designed for use with remotely controlled manipulators which make it an easy matter for the operator to effect a properly aligned telescopic engagement of male and female electrical connector units as the movable one of the connector units is grasped by the jaws of a remotely controlled manipulator and brought into telescoping relation with a mating connector unit. A related object of the invention is to provide a connector assembly as described with unique guiding means for insuring proper axial and circumferential, angular alignment as the movable connector unit is moved into position contiguous to a stationary connector unit, even when the connector units are substantially misaligned axially and circumferentially when they are first brought into engagement with one another.

The design of electrical connectors heretofore utilized in environments requiring the use of remotely controlled manipulators is such that it was frequently difficult to make the position adjustments of the manipulator arm necessary to gain access to or bring the movable connector unit carried thereby into proper axial and/or circumferential angular alignment with a stationary connector unit because of the limited number of directions of access to the movable or stationary connector units caused by obstructing objects adjacent to the connector unit.

It is accordingly an object of the invention to provide electrical connectors designed so that remotely controlled manipulators can gain easy access to or bring the movable connector unit carried thereby into proper axial and/or circumferential angular alignment with a stationary connector unit even when there are a limited number of directions of access to the movable or stationary connector units.

Still another object of the invention is to provide manipulator attachable connector units designed so that an operator at a remote point can readily determine when the telescoping male and female connector units have been brought into their fully telescoped position where contact resistance between the connectors is at a minimum and the holding force therebetween is at a maximum.

An overall object of the invention is to provide manipulator attachable connector units satisfying one or more and preferably all of the objectives just described and which are rugged and reliable in operation.

BRIEF DESCRIPTION OF THE INVENTION

While the present invention envisions the use of any one or more of the features in a given connector unit assembly to be described, the most advantageous form of the invention combines the various features to provide for maximum reliability and ease of connection and disconnection of the connector units involved. Also, while the present invention has its most important application in connectors of the type where a large number of longitudinally extending plug terminals must be brought into proper alignment and engagement with a similar number of female socket terminals, in accordance with the broadest aspect of the invention, the connector units can be of the type where the connector units do not have telescoping plug and socket terminals but, nevertheless, must be brought into proper axial and circumferential alignment and into full telescoping relation by remotely controlled manipulator apparatus.

In accordance with one of the features of the invention, to increase the directions of access of the grasping jaws of remotely controlled manipulator apparatus to a movable connector unit, the movable connector unit is constructed with a laterally extending elbow portion on the end of the connector unit remote from the end which telescopingly interfits with the other connector unit and which displaces the conductors to one side of the movable connector unit. Also, the elbow portion is a separately attachable unit which makes connection with the housing of the movable connector unit through a swivel connection or the like, which permits the elbow portion to be adjusted and locked into any radial position with respect to the movable connector unit housing, to make it easier to move the movable connector unit into telescopic relation with a stationary connector unit mounted in a relatively inaccessible position which provides a limited degree of access thereto.

There is provided on the exterior of the housing of the movable connector unit at least one and preferably a pair of outwardly spring-urged depressible members positioned on opposite diametrical sides of the housing. The depressible members control projecting latch means which interlock with the stationary connector unit to prevent the ready separation thereof only when the connector units are brought into full telescoping relation. The depressible members can be engaged by the grasping jaws of a remotely controlled manipulator brought into engagement therewith from behind the elbow portion of the movable connector unit or from any lateral side thereof. When the grasping jaws are moved to their fullest extent against the depressible members, the movable connector unit is then clamped into position for movement by the manipulator. For assembly of the connector units, the preferred position of the manipulator is the position just behind (i.e., at the longitudinally outwardly facing side of) the elbow portion of the movable connector unit where a frame carrying the grasping jaws projecting longitudinally of the connector unit and the jaws are free to rotate as a unit about an axis coextensive with the longitudinal axis of the movable connector unit, to aid in bringing the movable connector unit into proper, circumferential, angular alignment with a stationary connector unit. (Most remotely controlled manipulators are designed to support the grasping jaws for free or driven rotation about an axis parallel to the direction in which the grasping jaws project or extend from a supporting frame). The accessibility of the depressible members from the lateral sides of the movable connector unit is advantageous especially during the process of disconnecting an already mounted, movable connector unit from the other connector unit.

When the connector units are in partial engagement, the release of the pressure on the depressible members by the grasping jaws of a manipulator will cause the latch means thereof to ride along raised surfaces of the other connector unit. Portions of the latch means which form a part thereof are preferably brightly colored so as to be readily visible only during either the depressed or released condition of the depressible members. If the latch means are so colored, they would be visible when they ride on the raised surfaces of the stationary connector unit. With the manipulator located on the longitudinally, outwardly facing side of the elbow portion of the movable connector unit, the connector units can then be brought into full telescopic relationship by merely moving the manipulator frame against the elbow portion of the movable connector unit. Then, when the movable connector unit has been fully mounted in position on the stationary connector unit, the latch means suddenly fall into recesses where the depressible members assume their outermost positions. If the latch means are brightly colored, they suddenly become invisible to the operator when they drop into the recesses to inform the operator that the connector units are fully mated.

In accordance with another feature of the invention, means are provided for automatically, axially and circumferentially, aligning the movable connector units with the stationary connector unit even when the connector units are substantially misaligned, for example, by as much as plus or minus 15°. Such wide angle, self-aligning means eliminate damage to the connector units and the time consuming "start over" actions often required with manipulator, attachable, connected assemblies of the prior art. While various means have been devised in the prior art for bringing slightly misaligned connector units into axial and circumferential alignment as, for example, the means disclosed in U.S. Pat. No. 3,094,364 to Lingg, the self-aligning means of the present invention is far more effective because it provides self-alignment under much wider angles of misalignment. To this end, one of the connector units is provided with only a single projection in the form of a tapered key which fits within a keyway in the other connector unit before the contact terminals thereof come into engagement. The key has longitudinally, outwardly converging and facing radially extending surfaces terminating in a pointed end which initially enters the keyway which progressively, angularly aligns the connector units when they are brought closer together. While the Lingg patents shows a number of tapered projections for circumferential aligning purposes, it has been discovered that the use of more than one such tapered projection, because of the difficulty in accurately locating more than one tapered projection with respect to another, makes it difficult if not impossible effectively to utilize such tapered projections for circumferential alignment purposes when the degree of misalignment is at all substantial. Also, additional tapered projections form additional abutment surfaces which can cause jamming of the connector units when they are in substantial, angular, misalignment with one another.

As an aid in effecting axial alignment between the connector units, the outer connector unit has connector unit-receiving passageways which progressively decrease in size proceeding further inward into the outer connector unit, and the passageways of different diameter are interconnected by inwardly tapered conical walls which aid in the guiding procedure. Also, to aid the operator in determining which side of the movable connector is to be at the top or bottom thereof when held and moved by the manipulator apparatus, aligning projections are provided extending radially outwardly from both connector units so that the projections can be brought into alignment when the movable connector unit is brought contiguous to the stationary connector unit. Moreover, to prevent the mating of connector parts which are not electrically designed to mate with one another, the complimentary connector units can be color coded and a small projection provided on one of the connector units adapted to enter a coding aperture in the other of same when the two connector units are already properly aligned with one another.

DESCRIPTION OF DRAWINGS

FIG. 3A is a longitudinal, vertical, sectional view through the connector units shown in FIG. 2, after being brought into fully telescoping relation;

FIG. 3B is a plan and partially horizontal, sectional view of the elbow portion of the movable connector unit shown in FIG. 2;

FIG. 4 is an enlarged, fragmentary view of contiguous portions of the outer and inner connector units of FIGS. 1–3 when the inner connector unit is just partially moved within the outer connector unit;

FIG. 5 is a view corresponding to FIG. 4 when the outer and inner connector units are brought into fully telescoping relationship;

DESCRIPTION OF EXEMPLARY EMBODIMENT OF THE INVENTION

Figure 1:
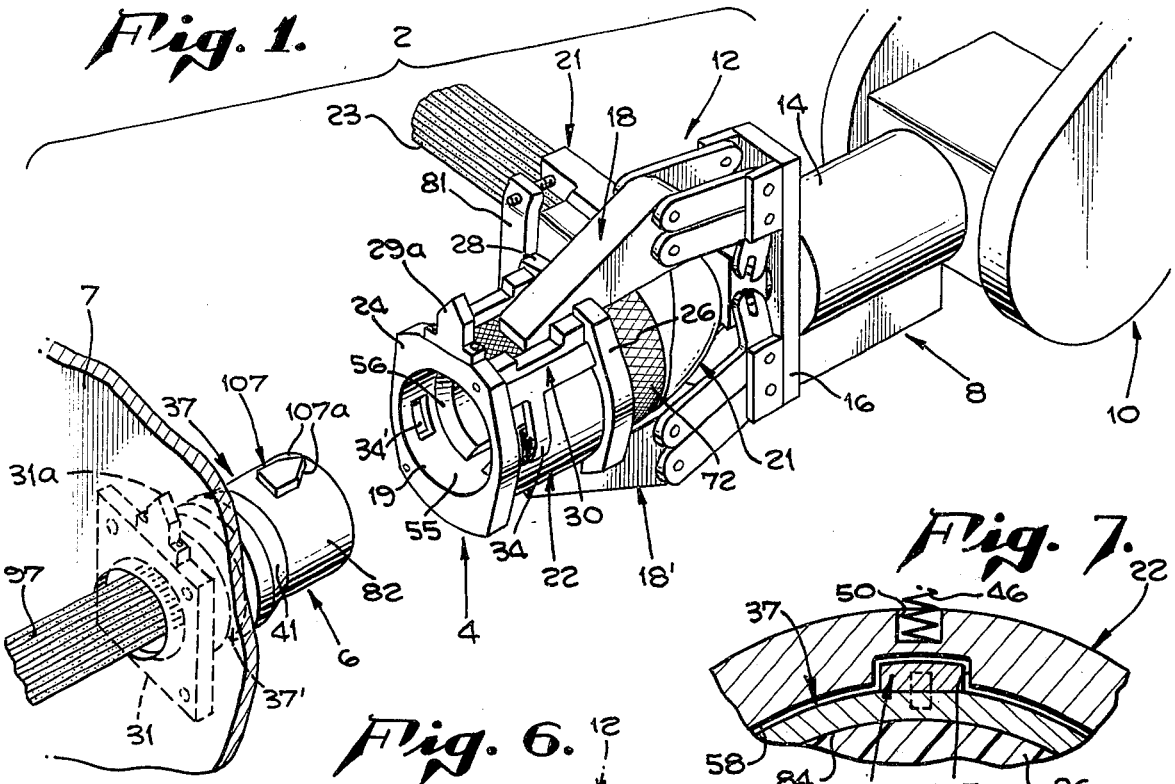
FIG. 1 is a perspective view showing a movable connector unit of the invention held in position by the grasping jaws of a remotely controlled manipulator as the movable connector unit is being brought into telescoping relation with a stationary connector unit of the invention mounted on a wall.
Figure 7:
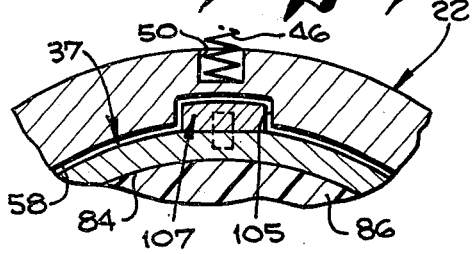
FIG. 7 is a fragmemtary, transverse, sectional view through the connector units shown in FIG. 5, taken along section lines 7—7 therein.

The drawings illustrate a connector assembly 2 incorporating the various features of the most preferred form of the present invention. As thereshown, outer and inner connector units 4 and 6 are designed for telescoping engagement where longitudinal extending plug and socket contact terminals thereof are fully engaged when the connector units are telescoped to their fullest exent, as shown in FIG. 3A. In the most preferred form of the invention, the inner connector unit 6 is mounted on a stationary wall 7 and the outer connector unit 4 is a movable connector unit which, during assembly of the connector units, is carried and manipulated into full telescoping relationship with the inner connector unit by a remotely controlled manipulator, generally indicated by reference numeral 8, brought adjacent the stationary, inner connector unit 6. One of the features of the present invention guides the outer and inner connector units automatically into longitudinal, axial and circumferential alignment, despite a large degree of initial misalignment, so that the operator of the manipulator 8 only has to bring the outer connector unit into a very rough alignment (which can vary as much plus or minus 15°) in the process of initially moving the outer connector unit over the inner connector unit.

The remotely controlled manipulator 8, per se, does not constitute a novel aspect of the present invention, and any one of a number of well known manipulators may be utilized to bring the outer connector unit 4 into telescoping relationship with the inner connector unit 6. (Also, while not disclosed herein, both connector units could be held by separate, remotely controlled manipulators and moved, one with respect to the other, to effect their interconnection.) The manipulator 8 illustrated shows the portion 10 and the hand portion 12 of a model 6000 manipulator, manufactured by Programmed and Remote Systems Corporation of 899 West Highway, 96 St. Paul, Minnesota.

Interconnecting the wrist portion 10 and the hand portion 12 of this manipulator is a drive control portion 14 which can effect bodily rotation of the hand portion 12 about an axis corresponding with the longitudinal axis of the outer connector unit 4. The drive control portion 14 also effects movement of a pair of grasping jaws 18–18' toward and away from one another in a direction transverse to this longitudinal axis. The grasping jaws 18–18' are mounted to project generally transversely of a frame member 16 and have confronting surfaces **18*a*–18*a*' (see FIG. 2) which remain generally parallel to one another as they clamp the outer connector unit 4** in a manner to be described.

The outer connector unit includes a housing 22 with an opening 19 at its front end into which the inner connector unit 6 is insertable, and an elbow portion 21 at the other end. The elbow portion 21 is preferably a separate unit which is adjustably attachable to the housing 22 in a manner to be described and extends laterally therefrom to direct insulated conductors 23 extending from the outer connector unit to one lateral side thereof. The elbow portion 21, thus, enables the frame 16 of the manipulator 8 to be brought adjacent the rear, longitudinally, outwardly facing, flat side **21*a* of the elbow-forming unit 21 so that the grasping jaws 18–18' extending longitudinally and centered over the outer connector unit 4 can be brought into grasping engagement with portions of the outer connector unit to be described, while being rotatable for connector unit aligning purposes about the longitudinal axis of the outer connector unit, as explained. Electrical conductors extend longitudinally into the housing 22 where they terminate in forwardly, longitudinally facing plug terminals 25**.

As best shown in FIG. 3A, the outer connector unit housing 22, which may be made of high strength, stainless steel, as illustrated, has a cylindrically shaped main body portion **22*a* terminating at the front end thereof in a radially, outwardly extending flange 24 and at its rear end in a radially, outwardly extending flange 26. The rear flange 26 has at the top and bottom thereof outwardly and longitudinally, axially opening slots 28–28' for receiving the grasping jaws 18–18' of the manipulator 8 therein when the manipulator 8 is in position behind the outer connector unit 4, as shown in FIG. 1. The front flange 24 has extending upwardly therefrom an orientation and coding projection 29*a* which corresponds in shape to an orientation coding projection 31*a* projecting upwardly from and anchoring flange 31 of the inner connector unit (see FIG. 1). The orientation and coding projections 29*a*–31*a*** of differently functioning connector units will be shaped differently to make it an easy matter to determine properly matching inner and outer connector units. The connector units may also be color coded for matching purposes.

Figure 6:
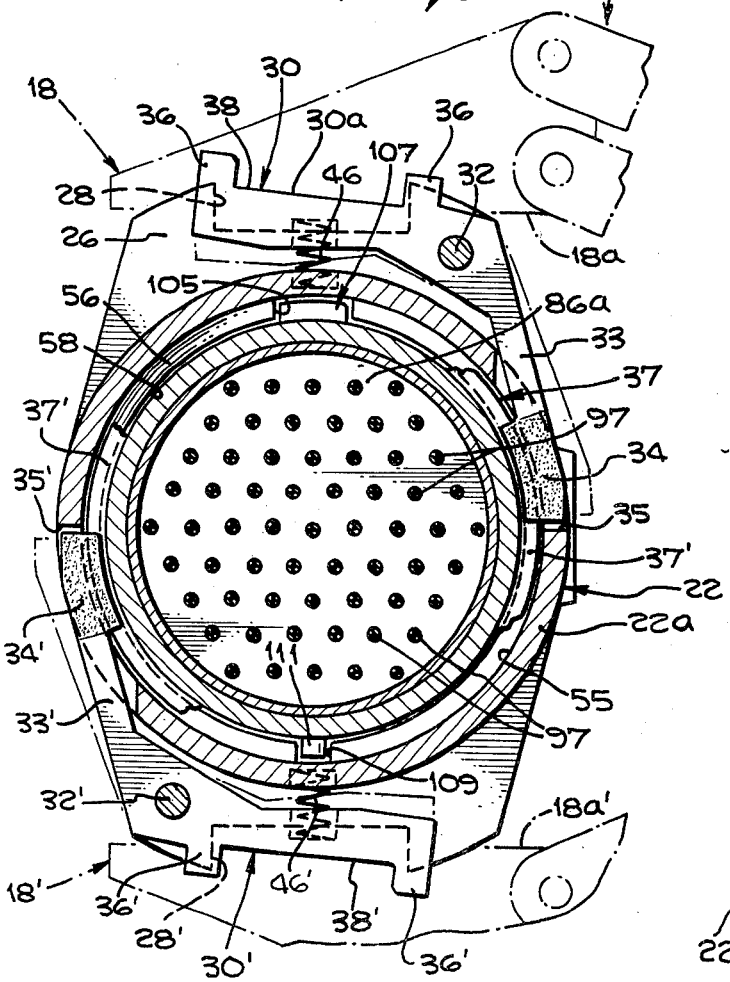
FIG. 6 is a transverse, sectional view through FIG. 3A, taken along sections lines 6—6 therein, and shows in phantom lines the placement of a pair of grasping jaws of the remote manipulator of FIG. 1 about a pair of depressible members on the outer connector unit, when the grasping jaws are brought into position from a lateral side of the outer connector unit.
Figure 8:
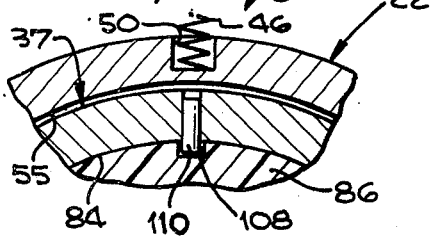
FIG. 8 is a fragmentary, transverse, sectional view through the connector units shown in FIG. 5, taken along section line 8—8 therein.
Figure 9:
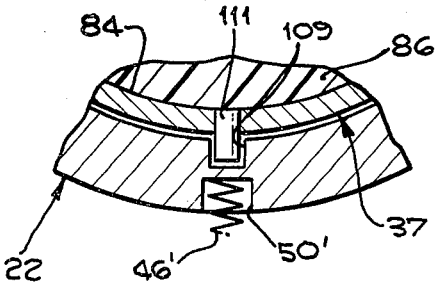
FIG. 9 is a fragmentary, transverse, sectional view through the connector unit assembly unit of FIG. 3A, taken along section line 9—9 therein.

Releasable means are provided for preventing the separation of the outer and inner connector units 4 and 6 once they are in full engagement. This releasable means includes, in the most preferred form of the invention, a pair of pivoted levers 30–30', best shown in FIG. 6, pivotally mounted on opposite diametrical sides of the cylindrical, outer body portion **22*a* of the outer connector unit housing. The levers 30–30' have main body portions 30*a*–30*a*' extending substantially the full distance between the inner faces of the front and rear housing flanges 24 and 26. The levers are pivotally mounted upon stationary pivot pins 32–32' extending through the main body portions 30*a*–30*a*' of the levers 30–30' and the front and rear flanges 24 and 26. Latching projections 34–34' extend from the ends of arms 33–33' projecting from the main body portions 30*a*—30*a*' of the levers 30–30'. The arms 33—33' pass through apertures 35—35' formed in the main body portion 22*a* of the outer connector unit housing and the latching projections are adapted to make interlocking engagement with the defining walls of an annular recess 37' formed in the cylindrical body 37 in the inner connector unit 6**.

The main body portions **30*a*—30*a*' of the levers 30–30' have laterally spaced, raised, marginal portions 36—36 and 36'—36' and depressed, knurled grasping jaw-receiving portions 38–38'. The raised, marginal portions 36—36 and 36'36' thereof project above the rear housing flange 26. When the outer connector unit has been partially applied over the inner connector unit 6, in the absence of a clamping pressure on the main body portions 30*a*–30*a*' of the levers 30—30, the raised, marginal portions 36—36 36'—36' thereof would be recessed within the margins of the rear housing flange 26 where they would not be readily visible. The main body portions 30a–30a' of the levers 30–30' are cammed into this position by the engagement of the latching projections 34–34' with raised surfaces like 41 and 43 on the inner connector unit body 37**.

The levers 30–30' are spring-urged into their outer position by pairs of coil springs 46—46 and 46'—46' respectively extending between confronting recesses 48–50 and 48'–50' formed in the confronting surfaces of the main body portions 30a–30a' of the levers 30–30' and the main body portion 22a of the outer connector unit housing body 22. It is apparent that when the main body portions 30a–30a' of the levers 30–30' are depressed, this will raise the latching projections 34–34' from the annular recess 37' in the body 37 of the inner connector unit 6.

The outer connector unit body 22 has a series of inner longitudinally extending passageways or compartments of progressively varying diameter for aiding in the axial alignment of the inner and outer connector units before the longitudinal plug terminals 25 of the outer connector unit 4 begin to make engagement with corresponding socket terminals 25' in the inner connector unit body 37. To this end, beginning with the outer margin of the opening 19 into the outer connector unit housing, there is provided preferably an inwardly converging, narrow, conical entryway 54 much larger than the inner connector unit body 37, which entryway 54 terminates in a cylindrical passageway portion 55, in turn, terminating in an inwardly converging, conical passageway portion 56, terminating in a cylindrical passageway portion 58. The apertures 35 and 35' into which the latching projections 34–34' of the levers 30–30 ' extend are formed in the cylindrical passageway portion 55. The cylindrical passageway portion 58 terminates in an inwardly diverging, conical passageway portion 59, terminating in a short, cylindrical passageway portion 60 to leave clearance spaces for metal cut from the housing 22 by the cutting tool which forms various keyways to be described. At this point, the inner diameter of the outer connector unit housing suddenly decreases to a much smaller diameter to form an aperture 61 which suddenly opens onto a larger cylindrical passageway portion 62 to define an annular, bearing shoulder 63 against which is urged a shoulder portion of a terminal-carrying, insert member 64 made of a suitable, synthetic, plastic material.

Figure 2:
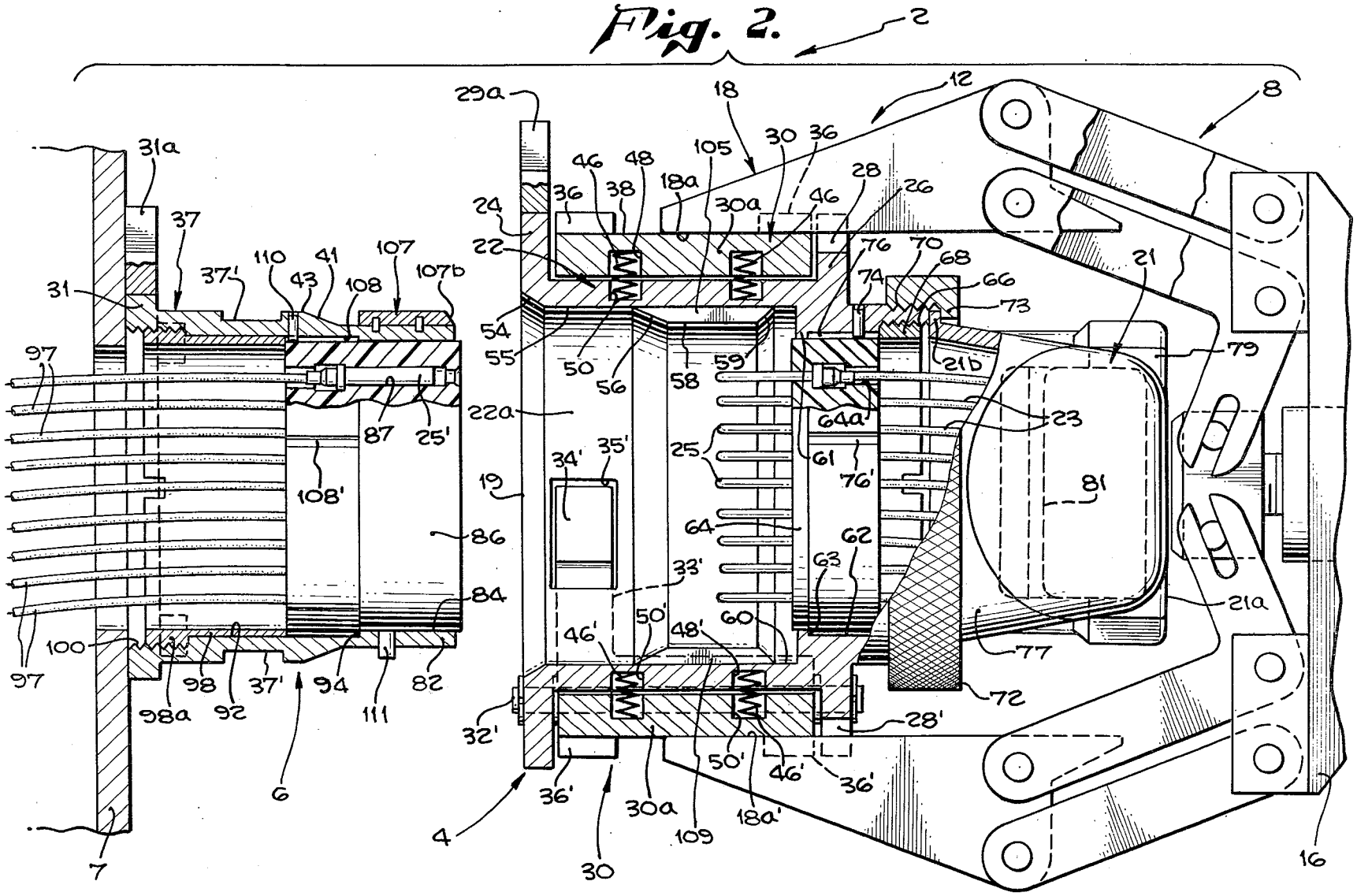
FIG. 2 is an enlarged, partially elevational and partially longitudinal, sectional view through the connector units of FIG. 1 before they are interconnected.

The passageway portion 62 terminates in an enlarged, threaded, internal passageway 66 into which is threaded a retaining ring 68 which abuts against the insert member 64 to hold the same within the passageway 62. The rear end of the outer connector unit body portion 22a terminates in an externally threaded portion 70 behind the flange 26, which portion receives a securing nut 72 which adjustably holds the elbow unit 21 in a fixed adjusted position upon the body portion 22a of the outer connector unit 4. The securing unit 72 has an inwardly extending annular lip 73 engaging a flange 21b of the elbow unit 21 which flange abuts the rear face of the housing 22, as best shown in FIG. 2. By loosening the nut 72, the elbow unit 21 can be pivoted bodily into any one of a number of positions in a plane transverse to the longitudinal axis of the outer connector unit housing 22.

The insert member 64 carries the plug terminals 25 in open-ended apertures 64a therein and is supportable in any one of five different positions within the housing 22. To this end, the insert member 64 has a series of axially extending keyways or slots like 76 or 76' which slidably receive a pin 74 projecting inwardly from the housing 22.

The elbow unit 21 can be designed in a number of ways. As illustrated in FIG. 3B, it is made of a number of metal pieces, preferably stainless steel, one of which is an inner body portion 77 terminating in the aforementioned flange 73 which defines part of a passageway through which the conductors 23 extend. The body portion 77 is connected to an outer body portion 79 in a suitable way such as by screws 78 passing through a portion of the body portion 79 and threading into body portion 77. The body portion 79 terminates in a flanged clamp portion 79' which cooperates with a similarly shaped clamp piece 81. The clamp portion 79' and clamp piece 81 are adjustably forced together around the conductors 23 passing through confronting recesses 79a' and 81a by clamping screws like screws 83 which clamp around the conductors 23 when outer body portion 79 is removed the full length of the passageway in the inner body portion 77 is exposed.

The inner connector unit body 37 is made of a high strength, stainless steel which includes a cylindrical front end portion 82 (FIG. 2) having a cylindrical passageway 84 therein which receives a socket terminal-carrying, insulating insert member 86 made of a suitable, synthetic, plastic material. The insert member 86 has open-ended apertures 87 containing the socket terminals 25' and a flanged portion 86a which abuts a shoulder 94 formed by an enlarged, cylindrical passageway 92 in the inner connector unit body 37. Disposed within the insert member 86 apertures 87 are the socket terminals 25' into which extend cable conductors 97.

The insert number 86 is held in place of a retaining sleeve 98 having an externally threaded flange 98a threading into a threaded aperture 100 formed within the rear end of the inner connector unit body 37. The aforementioned securing flange 31 at the rear end of the body 37 terminates the rear end of the inner connector unit 6 and is apertured to receive any suitable securing means for anchoring the same to a stationary wall or the like as shown in FIG. 1. As in the case of the insert member 64, the socket terminal-carrying insert member 86 is preferably supportable in any one of five different, angular positions. To this end, the insert member 86 is provided with a number of longitudinally extending slots like 108 and 108', each adapted in different positions of the insert member slidably to receive a pin 110 projecting inside of the inner connector unit body 37. The insert member 86 is preferably sized so that the front end thereof projects slightly beyond the inner connector unit body 37.

As previously indicated, one of the features of the invention is in the means which automatically align the inner connector unit 6 with the outer connector unit 4 before the plug terminals 25 of the outer connector unit reach the terminal-carrying insert member 86. These means include the already described passageway portions 54, 55, 56 and 58 in the outer connector unit and the design of the cylindrical body 37 of the inner connector unit which is much smaller than both the first conical entryway 54 and the first cylindrical passageway portion 55. Thus, even though there is substantial angularity or misalignment between the longitudinal axes of the outer and inner connector units, the inner connector unit can be simply and easily moved into position within the front end portion of the outer connector unit before the front end portion of the inner connection reaches the second inwardly tapering, conical passageway portion 56 which finally guides the inner connector unit into more precise longitudinal axial alignment with the outer connector unit.

As previously indicated, during the longitudinal movement of the inner connector unit 6 within the outer connector unit 4, the main body portions 30*a*–30*a*′ and the levers 30—30 will usually be depressed, so that the latching projections 34–34′ of these levers are moved into an outermost position where they are readily visible and withdrawn from the interior of the outer connector unit and are readily visible by the operator of the manipulator 8. To facilitate their visibility, the latching projections may be brightly colored in contrast to the metallic color of the adjacent surfaces. Once the plug terminals 25 enter the socket-carrying apertures 87 of the inner connector unit, clamping pressure on the levers 30–30′ can be released. The latching projections 34–34′ then ride upon the raised, conical and cylindrical surfaces 41 and 43 of the inner connector unit body, which surfaces hold the outermost portions thereof and are brightly colored in their readily visible positions. Further axial movement imparted to the outer connector unit will finally bring the two connector units into fully telescoping engagement (FIG. 3A), where the brightly colored latching projections 34–34′ disappear into the inner connector unit body recess 37 to inform the operator that the connector units are now in full telescoping engagement. The conical surface 41 of the inner connector unit body which faces inwardly of the outer connector unit and forms an abutment shoulder will then be in engagement with the defining walls of the conical passageway portion 56 of the outer connector unit forming another abutment shoulder, but the confronting ends of the connector units are preferably in spaced relation, so that the relatively less durable, protecting plastic insert members will never be pushed into abutment.

Means are also provided to guide the connector units into proper, circumferential, angular alignment so that the plug terminal connectors projecting from the insert member 64 of the outer connector unit will be aligned with the socket terminal-containing apertures of the insert member 86 of the inner connector unit before the plug terminals reach the same. To this end, a rectangular keyway 105 is cut longitudinally into the defining walls of the conical and cylindrical passageway portions 56 and 58, into which keyway is extendable a tapered key 107 near the front end of the inner connector unit body 37. The tapered key 107 has longitudinally, outwardly converging and facing radially, extending surfaces 107*a*—107*a* (FIG. 1) terminating in a pointed end which is preferably tapered in its vertical profile at 107*b* (FIG. 2). At its widest point, the tapered key 107 is only slightly narrower than the width of the rectangular keyway which progressively, angularly aligns the movable connector unit before the point is reached where the plug terminals 25 first enter the apertures in the insert member 86.

The defining walls forming the conical and cylindrical passageway portions 56 and 58 of the outer connector unit are also provided with a longitudinally extending rectangular slot 109 which is a coding slot adapted loosely to receive a pin 111 on the inner connector unit body after the tapered key 107 makes full guiding engagement with the keyway 105. The angular position of the slot 109 varies with the various connector unit assemblies so that any match-up between a coding pin 111 on the inner connector unit and a coding slot on the outer connector unit will indicate that the two connector units are designed to be used with one another. Otherwise, the inner and outer connector units involved cannot be fully mated.

To review the manner in which the manipulator 8 is utilized to bring the outer, movable connector unit 4 into full telescoping engagement with the inner connector unit 6, the grasping jaws 18–18′ of the manipulator are initially brought into clamping engagement with the depressible, grasping, jaw-receiving portions 38–38′ of the levers 30–30′, preferably from a point immediately behind the elbow unit 21 of the outer connector unit. This withdraws the latching projections 34–34′ of the levers 30–30′ from within the outer connector unit 4. The hand portion 12 of the manipulator 8 is oriented so that the aligning and coding projection 29*a* of the outer connector unit is at the same side of the movable connector unit as is the aligning and coding projection 31*a* of the inner connector unit. The outer connector unit 4 is then brought into position adjacent to the inner connector unit 6 and, while the operator permits the hand portion 12 of the manipulator 8 to rotate freely about a longitudinal axis and to move laterally in any direction, he imparts only a longitudinal motion to the hand portion 12 of the manipulator 8 to bring the outer connector unit over the inner connector unit. Even though there is a fairly wide angle between the longitudinal axes of the inner and outer connector units, the aforementioned guiding means of the invention will automatically guide the outer connector unit into proper, longitudinal and circumferential angular alignment with the inner connector unit 6 before the end of the plug terminals 25 begin to enter the socket terminal-carrying apertures of the insert member 86 of the inner connector unit 6. When the outer connector unit 4 has been positioned partially over the inner connector unit, the pressure on the grasping jaws 18–18′ can be removed, and the frame 16 of the hand portion 12 of the manipulator 8 can then exert a pushing force against the flat side 21*a* of the elbow portion 21 of the outer connector unit 4 to complete the full telescoping engagement of the outer and inner connector units, the completion of which is identified when the operator sees the latching projections 34–34′ disappear from view.

If there is such a substantial misalignment between the inner and outer connector units that cannot be handled by the guiding means of the invention, then some part of the outer connector unit other than the easily damaged plug terminals 25 will harmlessly contact a portion of the inner connector unit if the operator is reasonably alert by immediately stopping the movement of the manipulator.

As previously explained, the design of the connector assembly of the invention described is one where there is great flexibility in the angular position of the insert members 64 and 86. Additionally, the insert members 64 and 86, shown respectively mounted within the outer and inner connector units 4 and 6, can be mounted instead, respectively, within the inner and outer connector units 6 and 4.

It should be understood that other modifications may be made in the most preferred forms of the invention without deviating from the broader aspects thereof. For example, while the disclosed embodiment utilizes the disappearance from view of the latching projections 34 and 34′ as an indication that connector units have been fully telescoped, the raised, marginal portions 36—36 and 36'—36' of the grasping, jaw-receiving portions 30a–30a' may be utilized as a signaling means for this purpose, in which event it would be the visibility of these portions of the levers 30–30' which signal the operator that the connector units are in their fully telescoped positions. Also, while the present invention has its most important application when used with a remotely controlled manipulator, some aspects thereof have utility where the connector units are directly, manually assembled.

I claim:

1. Electrical connector apparatus comprising: telescoping inner and outer connector units, said outer connector unit including a housing with a main housing portion having an opening at one end into which said inner connector unit is longitudinally axially movable into said main housing portion of said outer connector unit, one of said connector units having on the end remote from the other connector unit an elbow portion laterally extending therefrom and exposed on at least one side thereof, an outwardly spring-urged means exposed on the outside of the connector unit having said elbow portion and depressible by the jaws of a manipulator brought opposite the apparatus in a direction generally transversely of the longitudinal axis of said outer connector unit opening therein, latch means operated by said depressible means and being normally in a latching position for interlocking with a portion of the other connector unit when the inner connector unit is fully inserted within said outer connector unit to prevent separation of the connector units, and having a release position when said depressible means is depressed a given extent for permitting separation of said connector units, insulated electrical conductors in said inner connector unit, which conductors terminate in longitudinally accessible contact terminals in said inner connector unit, and insulated electrical conductors in said outer connector unit, which conductors terminate in longitudinally accessible contact terminals in said outer connector unit and face toward the contact terminals of said inner connector unit, and make full, proper electrical engagement therewith when said inner connector unit is fully inserted within said opening of said outer connector unit housing and said inner and outer connector units have a given circumferential, angular relationship to one another, and the electrical conductors of the connector unit having said depessible means passing through, and being held in displaced position to one side of the connector unit by said elbow portion thereof to permit a manipulator to be brought into engaging position with said depressible means from the longitudinally, outwardly facing side of the elbow portion of the latter connector unit where the same is depressed to move the latch means to said release position and clamp the connector apparatus therewith for movement thereby to another location.

2. The electrical connector apparatus of claim 1, wherein said depressible means are a pair of depressible members on opposite diametrical sides of the connector unit having said elbow portion and each operating a separate latch means.

3. The combination of claim 1, wherein said depressible means of said first connector unit are a pair of depressible members on opposite diametrical sides of said first connector unit and each of which operates a separate latch member comprising said latch means, and said grasping jaws being contiguous to the longitudinally outwardly facing side of said elbow portion of said first connector unit and engaging both of said depressible members to depress the same and clamp the second connector unit therebetween.

4. The electrical connector apparatus of claim 1, wherein said laterally extending elbow portion is mounted for swiveled locked adjustment about an axis extending transversely of the longitudinal axis of said one connector unit.

5. The electrical connector apparatus of claim 1, wherein the electrical conductors of said connector units are longitudinally extending plug connectors on one of the units and corresponding longitudinally extending sockets for receiving the connectors on the other of same, and the longitudinally outwardly facing side of said elbow portion of one of said connector units having a flat laterally extending profile so that it can be readily engaged and pushed in the direction of the other connector unit to bring the plug and socket connectors into full telescoping relationship once the plug and socket connectors are partially in engagement.

6. The combination of claim 1, wherein said conductor terminals of said inner and outer connector units are longitudinally extending plug connectors on one of the same and longitudinally extending socket connectors on the other of same, and the longitudinally outwardly facing side of said elbow portion has an abutment surface opposite which the frame means of said manipulator is located so that it can abut and push the connector unit involved in the direction of the other connector unit after the grasping jaws are released from said outwardly spring-urged means.

7. The electrical connector apparatus of claim 1, wherein said depressible means are positioned to be engaged by a pair of confronting manipulator clamping jaws having generally parallel confronting grasping jaw surfaces brought into position thereover from either the outwardly longitudinally facing side of said elbow portion of the connector unit or from either opposite lateral side of the latter connector unit.

8. The electrical connector apparatus of claim 1, wherein said inner and outer connector units are provided with complimentary aligning means on said inner and outer connector units for guiding said units into proper angular alignment as said inner and outer connector units are moved into telescoping relation.

9. The electrical connector apparatus of claim 1 wherein said elbow portion has an inner portion which exposes an elbow passsageway for the full length thereof to permit connectors readily to be secured within the associated connector unit and an outer portion which completes the elbow portion and which is removably connected to the inner portion thereof so that the removal thereof exposes said elbow passageway.

10. The electrical connector apparatus of claim 1, wherein said depressible means includes at least a single lever pivoted along a longitudinal axis on said connector unit having said elbow portion, said lever having an exposed clamping jaw-receiving portion on one side of the pivot axis thereof and said latch means is on the end of the lever on the other side of said pivot axis.

11. The electrical connector apparatus of claim 7, wherein the exposed portion of said depressible means has longitudinally outwardly facing abutment shoulder means against which the manipulator clamping jaws can abut when the manipulator jaws extend transversely of the longitudinal axis of the connector units.

12. Electrical connector apparatus comprising: an outer connector unit including a housing with an opening at one end, an inner connector unit longitudinally, axially movable into said housing of said outer connector unit through said opening thereof, one of said connector units having exposed on at least one side thereof outwardly, spring-urged depressible means depressible in a direction generally transversely of the longitudinal axis of said housing opening, latch means operable by said depressible means and being normally placed into latching position where it interlocks with a portion of the other connector unit when the inner connector unit is fully inserted with said outer connector unit to prevent the separation of said connector units, said other connector unit having camming wall surface portions along which said latch means, during the undepressed condition of said depressible means, slides until the inner connector unit is fully inserted within said outer connector unit, and recess means just beyond said camming wall surfaces and into which said latch means interlockingly extends when said inner connector unit is fully inserted within said outer connector unit, said depressible means having a signalling portion which signals the entry of said latch means into said recess means.

13. The electrical connector apparatus of claim 12, wherein the visible portions of said depressible means has a substantially contrasting color to the contiguous portions of the connector unit upon which it is mounted.

14. Electrical connector apparatus comprising: an inner connector unit; an outer connector unit having a housing with an opening at one end for receiving said inner connector unit, and communicating with at least one pair of longitudinally aligned, inwardly, size decreasing, connecting passageway portions smoothly merging into one another through at least one inwardly tapering, conical passageway portion forming a longitudinal axis aligning shoulder and exposed longitudinally extending contact terminals inwardly of said conical passageway portion; said inner connector unit having longitudinally extending connector terminals matable with said longitudinal connector terminals of said outer connector unit only when the front end of said inner connector unit has moved by said conical passageway portion of said outer connector unit, and there is formed in the walls defining said conical passageway portion of said outer connector unit a keyway for receiving a key on said inner connector unit when moved into partial telescoping relationship with said outer connector unit; and means on said inner connector unit for guiding the same into circumferential, angular alignment with said outer connector unit comprising only a single, tapered, projecting key positioned to fully enter said keyway of said outer connector unit before said longitudinally extending contact terminals make initial engagement.

15. Electrical connector apparatus comprising: an inner connector unit; an outer connector unit having a housing with an opening at one end for receiving said inner connector unit which opening communicates with at least two longitudinally aligned, inwardly, size decreasing, connecting passageways and an outwardly axially facing aligning shoulder therebetween with a longitudinally extending slot therein and longitudinally extending contact terminals spaced from the front end of the innermost of said passageways; said inner connector unit being longitudinally axially movable into said housing opening and having a front end portion of smaller diameter than both of said passageways, said inner connector unit having longitudinal connector terminals matable with said longitudinal connector terminals of said outer connector unit only when the front end of said inner connector unit has moved into said innermost passageway with a given angular orientation and said innermost connector unit having a radial projection adapted to extend into said longitudinal slot, the relative shapes of said shoulder, slot and projection effecting upon engagement of said shoulder by said projection axial alignment of said connector units and upon entry into said slot of said radial projection said given angular orientation of said inner connector unit.

16. The electrical connector apparatus of claim 15 wherein said passageways are cylindrical and there is provided at the outer end of the outermost passageway a first inwardly tapering conical passageway portion merging therewith, said shoulder being a second inwardly tapering conical passageway portion merging with said innermost passageway.

17. The electrical connector apparatus of claim 15 wherein there is formed behind said radial projection a projecting abutment shoulder facing inwardly of the outer connector unit and which makes abutment with the outwardly axially facing shoulder of said outer connector unit when said inner connector unit has been fully telescoped within said outer connector unit.

* * * * *